US009903563B2

(12) United States Patent
Utting et al.

(10) Patent No.: US 9,903,563 B2
(45) Date of Patent: Feb. 27, 2018

(54) LOW GLARE LED LUMINAIRE

(71) Applicant: LANDSCAPE FORMS, INC., Kalamazoo, MI (US)

(72) Inventors: Ricky A. Utting, Grandville, MI (US); David L. MacKellar, Middleville, MI (US); Christopher E. Briolat, Kalamazoo, MI (US)

(73) Assignee: LANDSCAPE FORMS, INC., Kalamazoo, MI (US)

( * ) Notice: Subject to any disclaimer, the term of this patent is extended or adjusted under 35 U.S.C. 154(b) by 8 days.

(21) Appl. No.: 15/095,506

(22) Filed: Apr. 11, 2016

(65) Prior Publication Data

US 2017/0292680 A1 Oct. 12, 2017

(51) Int. Cl.

| | |
|---|---|
| ***F21V 1/00*** | (2006.01) |
| ***F21V 11/00*** | (2015.01) |
| ***F21V 13/14*** | (2006.01) |
| ***F21V 5/04*** | (2006.01) |
| ***F21S 10/04*** | (2006.01) |
| ***F21V 9/00*** | (2018.01) |
| ***F21V 7/00*** | (2006.01) |
| ***F21V 29/74*** | (2015.01) |
| ***F21V 29/89*** | (2015.01) |
| ***F21V 17/10*** | (2006.01) |
| ***F21V 19/00*** | (2006.01) |
| *F21Y 115/10* | (2016.01) |
| *F21S 8/00* | (2006.01) |
| *F21S 8/08* | (2006.01) |

(52) U.S. Cl.

CPC ..... *F21V 13/14* (2013.01); *F21S 10/04* (2013.01); *F21V 5/04* (2013.01); *F21V 7/00* (2013.01); *F21V 9/00* (2013.01); *F21V 17/101* (2013.01); *F21V 19/003* (2013.01); *F21V 29/74* (2015.01); *F21V 29/89* (2015.01); *F21S 8/036* (2013.01); *F21S 8/08* (2013.01); *F21Y 2115/10* (2016.08)

(58) Field of Classification Search

CPC ... F21V 13/14; F21V 5/04; F21V 9/00; F21V 29/74; F21V 29/89; F21V 17/101; F21V 19/003; F21V 7/00; F21S 10/04; F21Y 2115/10

See application file for complete search history.

(56) References Cited

U.S. PATENT DOCUMENTS

| | | | |
|---|---|---|---|
| 6,038,387 | A | 3/2000 | Machida |
| 6,688,752 | B2 | 2/2004 | Moore |
| 6,976,777 | B1 | 12/2005 | Herold |
| 7,671,541 | B2 | 3/2010 | Hickey |
| 7,695,171 | B2 | 4/2010 | Lederer |
| 8,390,216 | B2 | 3/2013 | Hickey |

(Continued)

*Primary Examiner* — Alexander Garlen
(74) *Attorney, Agent, or Firm* — Heslin Rothenberg Farley & Mesiti P.C.

(57) ABSTRACT

An LED luminaire with reduced glare provides a polar arrayed light gradient on a diffuser lens and replicates the appearance of a filament or tube lamp. The luminaire includes a housing having an opening, a diffuser lens extending across the opening, and a plurality of LEDs positioned within the housing behind the diffuser lens. The plurality of LEDs are arranged to generate a composite light pattern having a polar arrayed light gradient across an aperture of the diffuser lens. The polar arrayed light gradient has a light intensity that decreases concentrically with increasing radius.

17 Claims, 5 Drawing Sheets

(56) References Cited

U.S. PATENT DOCUMENTS

| | | | | |
|---|---|---|---|---|
| 8,698,729 | B2 | 4/2014 | Ward et al. | |
| 2002/0001193 | A1* | 1/2002 | Osawa | F21S 4/00 362/249.14 |
| 2003/0189831 | A1* | 10/2003 | Yoneda | F21K 9/00 362/294 |
| 2011/0051420 | A1* | 3/2011 | Gill | F21S 8/086 362/249.03 |
| 2011/0261567 | A1* | 10/2011 | Lee | F21S 8/086 362/249.03 |
| 2012/0127717 | A1* | 5/2012 | Venturini | F21V 19/001 362/244 |
| 2012/0206918 | A1* | 8/2012 | Lee | F21S 2/005 362/249.02 |
| 2014/0085883 | A1* | 3/2014 | Douglas | F21V 29/77 362/235 |
| 2014/0268733 | A1* | 9/2014 | Holland | F21V 21/096 362/231 |
| 2014/0268737 | A1* | 9/2014 | Athalye | F21V 13/04 362/235 |

* cited by examiner

LOW GLARE LED LUMINAIRE

FIELD OF THE INVENTION

This invention relates, in general, to LED luminaires and, more particularly, to LED luminaires especially well-suited for night time illumination of pedestrian areas, streets and roadways from elevated outdoor lights, with reduced glare.

BACKGROUND ART

For many years, lighting was primarily achieved using incandescent filament or high-intensity discharge (HID) tube lamps. Fundamentally inefficient at directing light only where it is needed, these products produce a central glowing sphere of light surrounded by a polar arrayed light gradient, through the use of reflectors and refractors.

Since about 2010, LED lamps have quickly become the primary choice for lighting due to their energy efficiency and promise of low maintenance. However, the major objection to the adoption of LED light sources is their propensity for being very bright with too much glare in the user field of view. The visual effect created by a typical LED luminaire is that of discreet dots of light, commonly in a rectilinear pattern, with the capability of being quite bright with high glare.

Glare is not only discomforting but may also impair an individual's vision for a period of time until the eyes adapt to the visual environment. Since elevated outdoor lights employed to illuminate outdoor spaces, streets and roadways are set against a dark black sky, the problem of glare is compounded.

A need thus exists for an LED luminaire that provides effective lighting with less glare.

BRIEF SUMMARY OF THE INVENTION

This need is satisfied, and multiple benefits achieved, according to the present invention, by the provision of an LED luminaire that creates less glare than typical LED luminaires and, thereby, lowers the visual adaption level of users.

By superimposing directed light beams from a plurality of LEDs, a polar arrayed light gradient across an aperture of a diffuser lens, and a visual effect reminiscent of a filament or tube lamp located behind the diffuser lens, are created. The result is an LED luminaire, more pleasant to view, with less glare and fewer points of light than other LED luminaires.

According to the present invention, a low glare LED luminaire includes a housing having an opening, a diffuser lens extending across the opening, and a plurality of LEDs positioned within the housing behind the diffuser lens. The plurality of LEDs are arranged to generate a composite light pattern having a polar arrayed light gradient across an aperture of the diffuser lens. The polar arrayed light gradient has a light intensity that decreases concentrically with increasing radius.

In a first embodiment, the plurality of LEDs are peripherally distributed and project inwardly directed, downwardly inclined light beams that converge and intersect behind the diffuser lens to create the composite light pattern. Advantageously, the composite light pattern appears as a visible sphere of light, when viewed through the diffuser lens.

Alternatively, the plurality of LEDs may project downwardly directed, diverging light beams that at least partially overlap to form the composite light pattern, which, in this embodiment, appears as a visible hemisphere of light, when viewed through the diffuser lens. The plurality of LEDs may comprise a central LED surrounded by other LEDs.

Advantageously, secondary optics may be associated with the plurality of LEDs to produce the directed light beams. At least some of the directed light beams may have a conical shape.

The low glare LED luminaire of the present invention may further include one or more circuit boards for mounting the plurality of LEDs. The LED luminaire may further include a cartridge deployable in the housing and mounting the one or more circuit boards and the diffuser lens. The cartridge may, advantageously, comprise cast aluminum, and include provision for air cooling and flats for mounting the one or more circuit boards.

The low glare LED luminaire may comprise an elevated outdoor light having the diffuser lens located at a bottom of the LED luminaire. Optionally, at least one separate, centered LED may be mounted below the diffuser lens. The at least one separate, centered LED, advantageously, has a warmer color temperature than the composite light pattern formed by the plurality of LEDs. The separate, centered LED may create the appearance of a flame, while the composite light pattern creates the appearance of a reflected ball of light created by the flame.

The low glare LED luminaire may be combined with a pole for supporting the LED luminaire in an elevated position and also serving to transmit electrical power to the LED luminaire.

The light pattern of the low glare LED luminaire may simulate the visual appearance of illumination from a filament or tube lamp, and further create a depth perception of a filament or tube lamp at a distance behind the diffuser lens. The light pattern may, thereby, visually disguise the plurality of LEDs.

The diffusing lens of the low glare LED luminaire is translucent and may have at least one of a flat, convex or concave shape. The plurality of LEDs, preferably, comprise high power, white light emitting LEDs.

The present invention also contemplates a low glare LED luminaire including a housing having an opening, a diffuser lens extending across the opening, and one or more LEDs positioned within the housing behind the diffuser lens and arranged to generate a light pattern having a polar arrayed light gradient across an aperture of the diffuser lens.

BRIEF DESCRIPTION OF THE DRAWING FIGURES

The present invention will be readily understood from the following detailed description, read in conjunction with the accompanying drawing figures, in which.

DETAILED DESCRIPTION

According to the present invention, an LED luminaire superimposes directed light beams from a plurality of LEDs to generate a composite light pattern having a polar arrayed light gradient across an aperture of a diffuser lens of the LED luminaire. The polar arrayed light gradient has a light intensity that decreases concentrically with increasing radius. The result is an LED luminaire with less glare and fewer points of light, than other LED luminaires.

Figure 1:
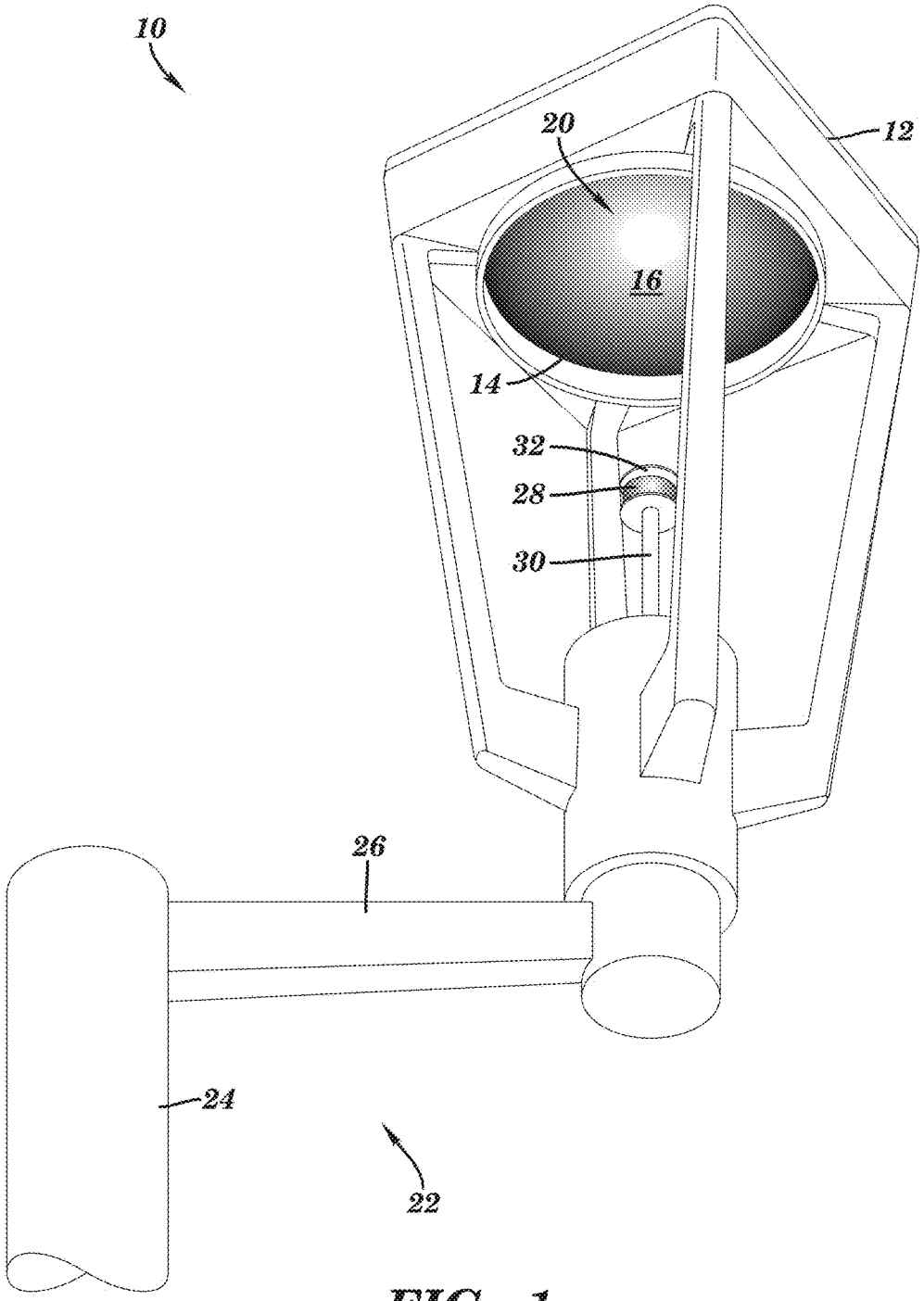
FIG. 1 illustrates a low glare LED luminaire constructed in accordance with the principles of the present invention, and the low glare light pattern produced thereby.

FIG. 1 illustrates an example of such a low glare LED luminaire. The luminaire 10 includes a housing 12 having a bottom opening 14. A diffuser lens 16 extends across the opening 14.

Positioned within housing 12, behind diffuser lens 16, is a plurality of light emitting diodes (LEDs) 18. The LEDs are arranged to generate a composite light pattern 20 having a polar arrayed light gradient across an aperture of the diffuser lens 16. The polar arrayed light gradient has a light intensity that decreases concentrically with increasing radius.

A support structure 22 supports the luminaire 10 in an elevated position for use, for example, as an outdoor light for illuminating streets, roadways or the like.

The support structure 22 may take various forms which may include a vertical pole 24 and support arm 26. Alternatively, the LED luminaire 10 may be supported from the side surface of a building or other structure, or may be suspended from an overhead support structure.

In addition to physically supporting and positioning the luminaire, the support structure may also convey electrical power to the luminaire.

Optionally, the LED luminaire 10 of FIG. 1 may be combined with at least one separate, centered LED 28 mounted below the diffuser lens 16. Advantageously, this separate, centered LED has a warmer color temperature than the composite light pattern 20 created by the plurality of LEDs. The optional, separate, centered LED 28 may give the appearance of a flame that appears to create a reflected ball of light behind the diffuser lens.

As illustrated in FIG. 1, the separate, centered LED 28 may be mounted upon a pedestal 30 which also supports an overhead reflector 32. Of course, other arrangements and structures can be employed to mount the optional, separate, centered LED below the diffuser lens.

Figure 2:
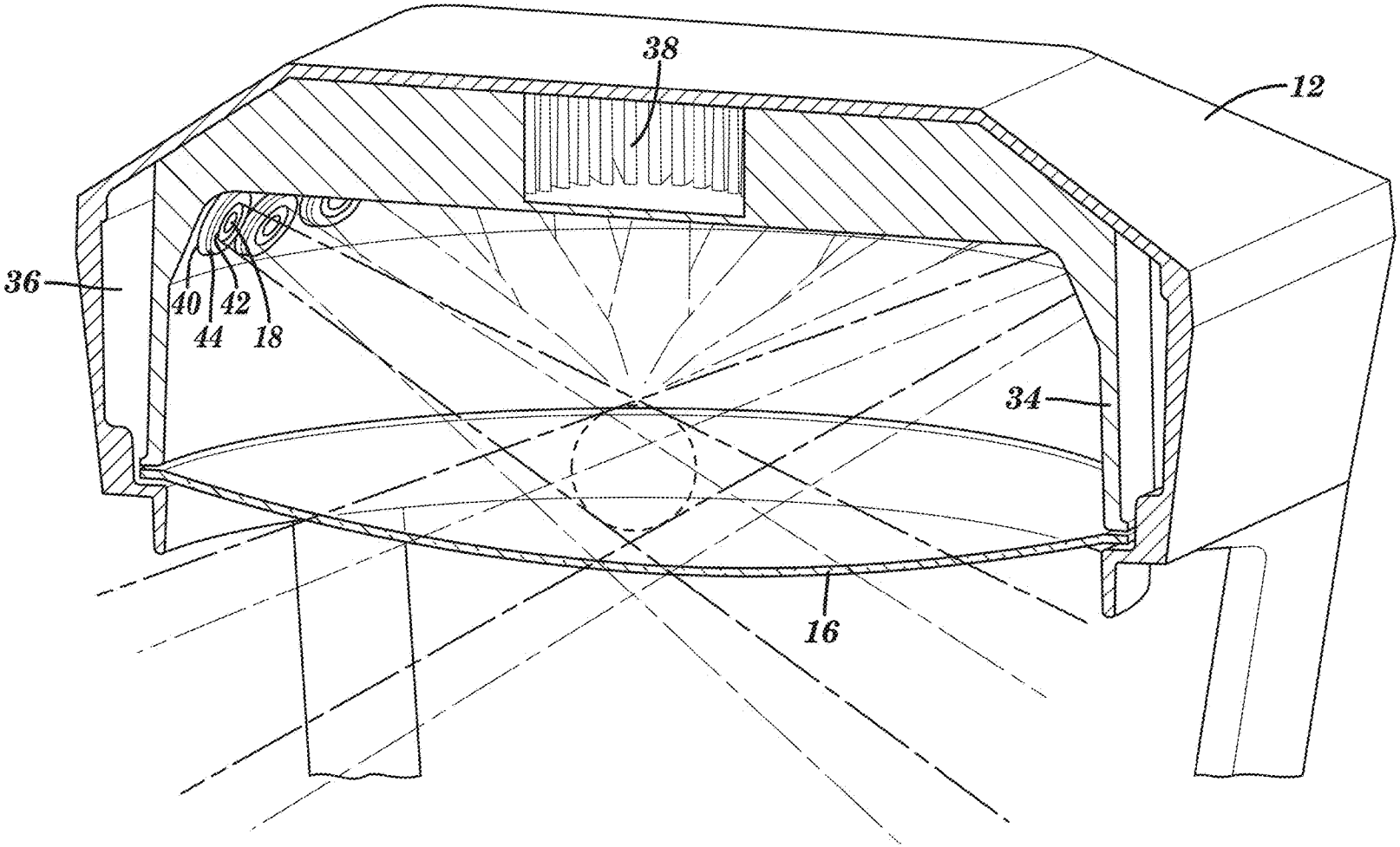
FIG. 2 is a sectional view of a first embodiment of the low glare LED luminaire of the present invention.

FIG. 2 illustrates a first approach for creating the desired composite light pattern of the low glare LED luminaire of the present invention. In this embodiment, an outer housing 12 is adapted to removeably receive a cartridge 34 that mounts both a plurality of LEDs 18 and the diffuser lens 16. A gap 36 between the cartridge 34 and at least portions of outer housing 12, along with a heat sink or cooling fins or other cooling provision 38, afford cooling to the LED luminaire.

The cartridge 34 which may, advantageously, comprise cast aluminum, or other material, has a bottom recess or opening receiving the diffuser lens 16. The diffuser lens may be removeably secured at the bottom of cartridge 34, with a bonding tape 38, or other adhesive, or other securing means.

Flats 40, or other suitable mounting structures, for the plurality of LEDs are peripherally distributed about the interior of cartridge 34. The flats 40 provide a desired distribution and orientation to the plurality of LEDs mounted thereon.

In one embodiment, a plurality of flats are equally spaced apart in a polar arrangement on the interior of the cartridge 34. A single LED 18, or multiple LEDs, may be mounted on each flat. In one embodiment, twelve LEDs are supported on the flats in such a way as to create the desired sphere of light just behind diffuser lens 16.

Each LED 18 may be combined with secondary optics 42 to create the directed, conically shaped beam of light. The plurality of LEDs are peripherally distributed and project inwardly directed, downwardly inclined light beams that converge and intersect behind the diffuser lens to create a light pattern comprising a visible sphere of light.

In one embodiment, twelve LEDs were evenly distributed in a polar array around the interior of a cartridge. A central axis of the directed light beam from each LED was downwardly inclined at an angle of about 55° to horizontal. Each directed light beam had an angular extent or spread of about 18°. The light beams converge and intersect at a small distance behind the light diffuser, for example, 1-1.5 inches behind the diffuser, creating both the desired polar arrayed light gradient across the aperture of the diffuser lens and a perception of a sphere of light at a depth behind the diffuser lens.

Of course, the number, type, spacing, distribution, orientation and spatial arrangement of the LEDs may vary, provided that they reproduce the desired visual effect.

One or more of the LEDs 18 and associated secondary optics 42, along with appropriate drive circuitry, can, advantageously, be mounted on individual printed circuit boards 44, and the circuit boards then secured to respective flats 40 of cartridge 34. Mounting of individual LEDs or groups of LEDs on separate circuit boards facilitates the desired positioning of the LEDs and aiming of the associated directed light beams.

LEDs 18 are preferably high output/high power LEDs producing white light. An example of an LED useful for this purpose is XP-G2 available from Cree of Raleigh, N.C. An example of the secondary optics that can be associated with the LEDs is PL 1728 UN available from Khatod of Pembroke, Mass. The circuit boards are preferably flat and may comprise a fiberglass reinforced material or a metal core printed circuit board, or the like.

In addition to supporting one or more LEDs and the associated secondary optics, the printed circuit board can also, advantageously, include related circuitry such as transient absorbing diodes, bypass diodes, etc. An LED driver circuit could also be included on the printed circuit board. The circuit boards may, advantageously, be glued, or otherwise adhered, or secured to the flats on the interior of the cartridge.

Other types of LEDs, secondary optics and circuit boards may also be used in the current invention.

Figure 3:
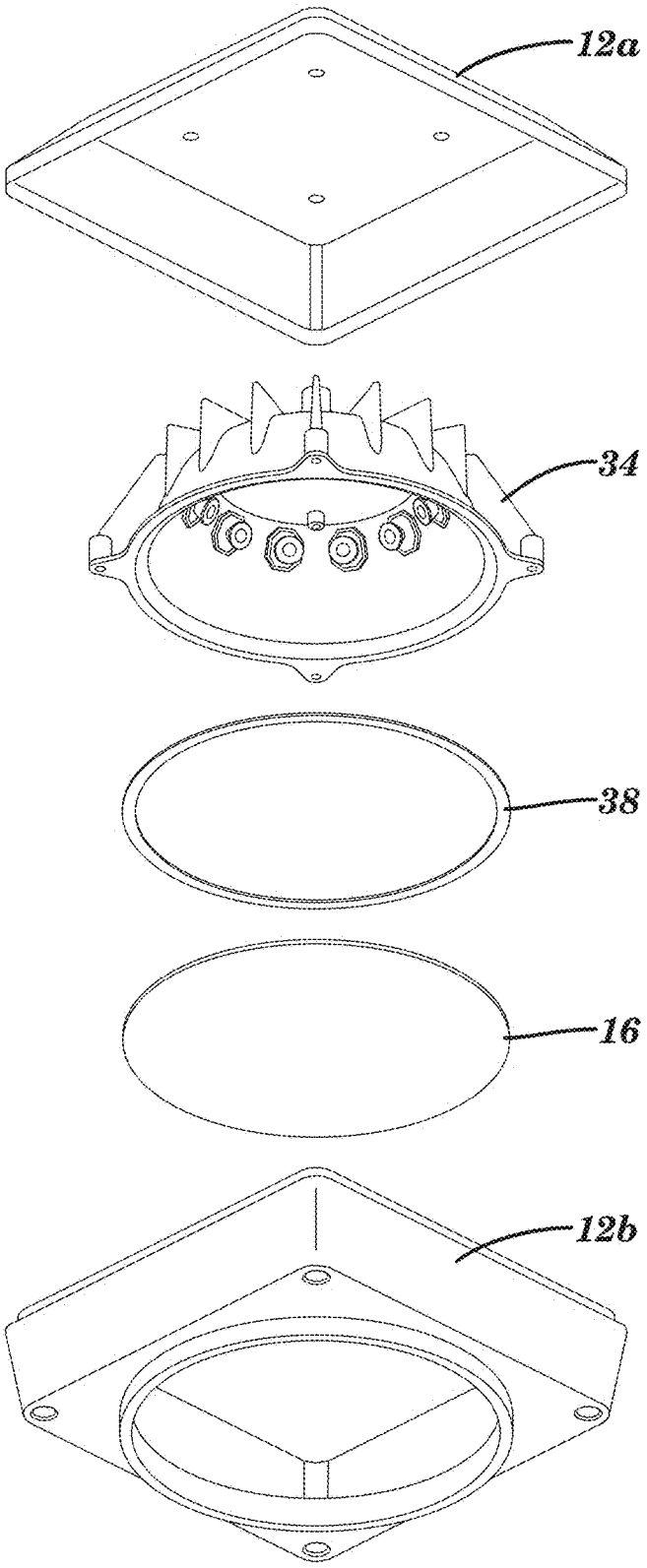
FIG. 3 is an exploded view of the low glare LED luminaire of FIG. 2.

The cartridge 34 with pre-mounted and aligned LEDs 18 and with diffuser lens 16 mounted at the bottom of the cartridge, may be secured, in any known fashion, within outer housing 12. As shown in the exploded view of FIG. 3, housing 12 may comprise a top cover 12A and a bottom cover 12B sandwiching cartridge 34. The cartridge facilitates easy assembly, removal, repair and/or replacement.

The diffuser lens 16 transmits, and simultaneously scatters, light and may have a flat, concave or convex shape. The aperture of the diffuser lens typically extends across substantially the full lens diameter. In one embodiment, the diffuser lens may comprise a modified acrylic product sold under the name "Acrylite" available from Evonik Cyro of Parsippany, N.J. Other materials, may, of course, be employed for use as the diffuser lens.

Figure 4:
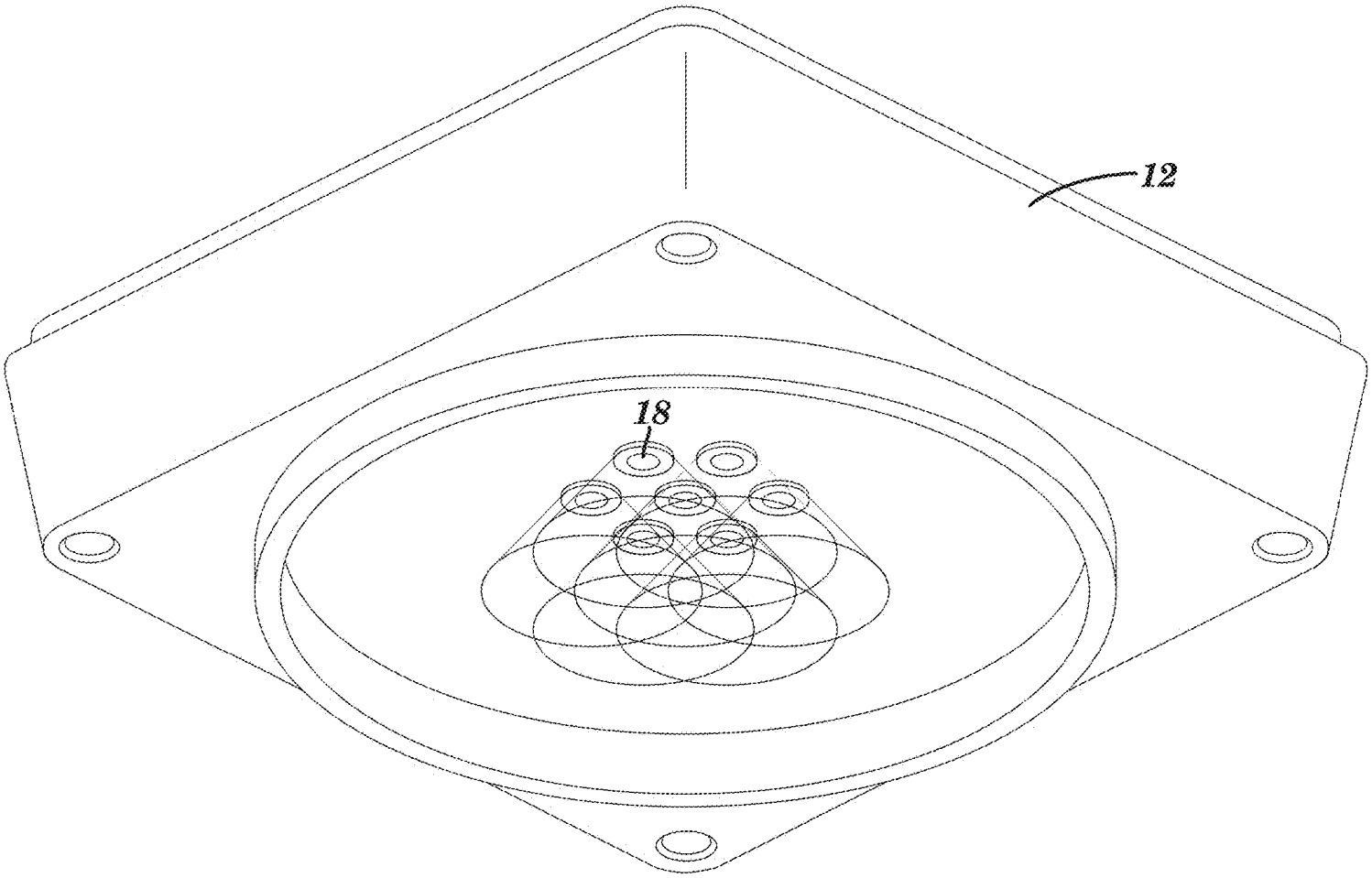
FIG. 4 illustrates a second embodiment of the low glare LED luminaire.

FIG. 4 illustrates a second approach for generating the desired polar arrayed light gradient with a low glare LED luminaire. In the illustrated embodiment, multiple downwardly facing LEDs are distributed evenly about a central downwardly facing LED. Secondary optics diverge the downwardly directed light beams from the LEDs to form a composite light pattern on a light diffuser. The composite light pattern has the desired polar arrayed light gradient and appears as a hemisphere of visible light when viewed through the light diffuser.

In an embodiment, for example, in which five LEDs are evenly distributed about the central LED, the secondary optics may spread the downwardly directed light beams from each LED into a 65° cone of light. Of course, the nature, and number of LEDs, their location, spacing, orientation and distribution and the nature of the secondary optics may vary, provided that the desired visual effect is created.

Compared to the first embodiment, the second embodiment may require fewer LEDs which can all be mounted on a single planar printed circuit board. However, the first embodiment produces a full sphere of light which more closely simulates the visual appearance of a filament or tube lamp.

Figure 5:
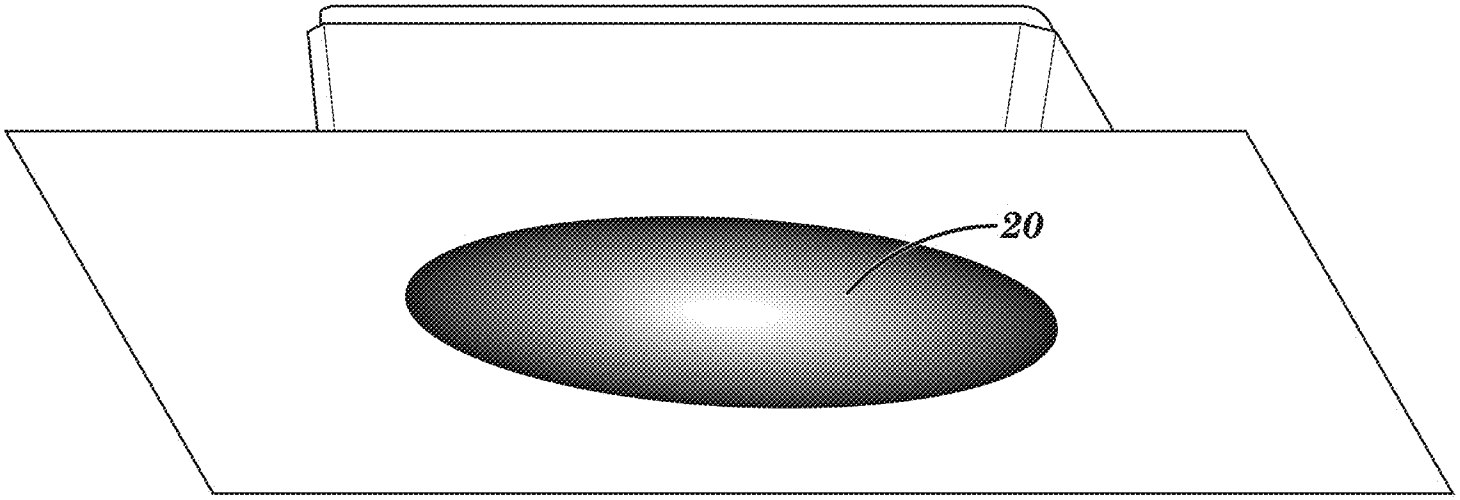
FIG. 5 represents the polar arrayed light gradient produced by the low glare LED luminaire of the present invention.

FIG. 5 provides a simulated representation of the polar arrayed light gradient produced by the LED luminaires of the present invention. As illustrated, light intensity decreases concentrically with increasing radius across the diffuser lens. In addition, the LED luminaires of the present invention provide a depth perception that a filament or tube lamp source is at some distance behind the diffuser lens. A similar visual effect may be produced using a single large LED, commonly referred to as a COB or chip on board, with secondary optics similar to those employed in the second embodiment described above; however, the resulting performance of this alternate approach may not be as good as the preferred first embodiment described above.

The present invention, thus, provides an LED luminaire exhibiting low glare and improved visual acuity at night. The visual appearance created is pleasing to the eye, and reminiscent of a filament or tube lamp while capitalizing on the efficiency and low maintenance of light emitting diodes.

The invention claimed is:

1. A low glare LED luminaire, comprising:

a housing having an opening;

a diffuser lens extending across said opening;

a plurality of LEDs positioned within the housing behind the diffuser lens, the plurality of LEDs being arranged to generate a composite light pattern having a polar arrayed light gradient across an aperture of the diffuser lens, the polar arrayed light gradient having a light intensity that decreases concentrically with increasing radius, wherein the plurality of LEDs are peripherally distributed in a polar array and project inwardly directed, downwardly inclined conically shaped light beams having central axes that converge and intersect behind the diffuser lens to create the composite light pattern, and the composite light pattern appears as a visible sphere of light, when viewed through the diffuser lens; and a centered LED, separate from the plurality of LEDs, mounted in front of the diffuser lens.

2. A low glare LED luminaire, comprising:

a housing having an opening;

a diffuser lens extending across said opening;

a plurality of LEDs positioned within the housing behind the diffuser lens, the plurality of LEDs being arranged to generate a composite light pattern having a polar arrayed light gradient across an aperture of the diffuser lens, the polar arrayed light gradient having a light intensity that decreases concentrically with increasing radius, wherein the plurality of LEDs comprise multiple downwardly facing LEDs evenly distributed about a central downwardly facing LED, and wherein the plurality of LEDs project downwardly directed, diverging light beams that at least partially overlap to form the composite light pattern, and the composite light pattern appears as a hemisphere of visible light when viewed through the light diffuser; and a centered LED, separate from the plurality of LEDs, mounted in front of the diffuser lens.

3. The low glare LED luminaire of claim 1, further comprising secondary optics associated with the plurality of LEDs to produce the directed light beams.

4. The low glare LED luminaire of claim 2, wherein at least some of the directed light beams have a conical shape.

5. The low glare LED luminaire of claim 1, further comprising one or more circuit boards for mounting the plurality of LEDs.

6. The low glare LED luminaire of claim 5, further comprising a cartridge deployable in the housing and mounting the one or more circuit boards and the diffuser lens.

7. The low glare LED luminaire of claim 6, wherein the cartridge comprises cast aluminum and includes a provision for cooling, and flats for mounting the one or more circuit boards.

8. The low glare LED luminaire of claim 1, wherein the LED luminaire comprises an elevated outdoor light and the diffuser lens is located at a bottom of the LED luminaire.

9. A low glare LED luminaire, comprising:

a housing having an opening;

a diffuser lens extending across said opening; and a plurality of LEDs positioned within the housing behind the diffuser lens, the plurality of LEDs being arranged to generate a composite light pattern having a polar arrayed light gradient across an aperture of the diffuser lens, the polar arrayed light gradient having a light intensity that decreases concentrically with increasing radius;

in combination with at least one separate, centered LED mounted in front of the diffuser lens, the at least one separate, centered LED having a warmer color temperature than the composite light pattern generated by the plurality of LEDs.

10. The low glare LED luminaire of claim 9, wherein the separate, centered LED creates the appearance of a flame and the composite light pattern creates the appearance of a reflected ball of light created by the flame.

11. The low glare LED luminaire of claim 1, in combination with a pole for supporting the LED luminaire in an elevated position and transmitting electrical power to the LED luminaire.

12. The low glare LED luminaire of claim 1, wherein the light pattern simulates the visible appearance of illumination from a filament or tube lamp.

13. The low glare LED luminaire of claim 12, wherein the light pattern creates a depth perception of a filament or tube lamp at a distance behind the diffuser lens.

14. The low glare LED luminaire of claim 1, wherein the light pattern visually disguises the plurality of LEDs.

15. The low glare LED luminaire of claim 1, wherein the diffusing lens transmits and simultaneously scatters light, and has at least one of a flat, convex or concave shape.

16. The low glare LED luminaire of claim 1, wherein the plurality of LEDs comprise high power, white light emitting LEDs.

17. A low glare LED luminaire, comprising:

a housing having an opening;

a diffuser lens extending across said opening;

one or more LEDs positioned within the housing behind the diffuser lens, the one or more LEDs being arranged to generate a light pattern having a polar arrayed light gradient across an aperture of the diffuser lens, the polar arrayed light gradient having a light intensity that decreases concentrically with increasing radius; and a centered LED, separate from the one or more LEDs, mounted in front of the diffuser lens.

* * * * *